US007699581B2

(12) United States Patent
Bayer et al.

(10) Patent No.: US 7,699,581 B2
(45) Date of Patent: Apr. 20, 2010

(54) RUN-IN COATING FOR GAS TURBINES AND METHOD FOR PRODUCING SAME

(75) Inventors: Erwin Bayer, Dachau (DE); Wilfried Smarsly, Munich (DE)

(73) Assignee: MTU Aero Engines GmbH, Munich (DE)

( * ) Notice: Subject to any disclaimer, the term of this patent is extended or adjusted under 35 U.S.C. 154(b) by 862 days.

(21) Appl. No.: 10/568,394

(22) PCT Filed: Jul. 28, 2004

(86) PCT No.: PCT/DE2004/001683

§ 371 (c)(1),
(2), (4) Date: Oct. 10, 2006

(87) PCT Pub. No.: WO2005/014979

PCT Pub. Date: Feb. 17, 2005

(65) Prior Publication Data

US 2009/0110560 A1 Apr. 30, 2009

(30) Foreign Application Priority Data

Aug. 12, 2003 (DE) ..... 103 37 094

(51) Int. Cl.
*F01D 11/12* (2006.01)

(52) U.S. Cl. ..... 415/173.1; 415/200; 427/372.2

(58) Field of Classification Search ..... 415/173.1, 415/200; 29/889.2; 427/250, 405, 419.1, 427/372.2

See application file for complete search history.

(56) References Cited

U.S. PATENT DOCUMENTS

| | | | | |
|---|---|---|---|---|
| 3,340,084 | A * | 9/1967 | Eisenlohr | 427/192 |
| 4,155,755 | A | 5/1979 | Sara | |
| 5,024,884 | A * | 6/1991 | Otfinoski | 428/328 |
| 5,340,783 | A * | 8/1994 | Anderson et al. | 501/134 |
| 5,545,431 | A | 8/1996 | Singh et al. | |
| 5,667,898 | A * | 9/1997 | Anderson et al. | 428/469 |
| 6,499,943 | B1 | 12/2002 | Beeck et al. | |
| 6,982,126 | B2 * | 1/2006 | Darolia et al. | 428/701 |
| 2003/0054196 | A1 | 3/2003 | Lau et al. | |

FOREIGN PATENT DOCUMENTS

| | | |
|---|---|---|
| EP | 0 526 670 | 2/1993 |
| WO | WO 03/033192 | 4/2003 |

OTHER PUBLICATIONS

Stoloff et al. "Emerging Applications of Intermetallics," Intermetallics, Elsevier Science Publishers B.V., vol. 8 No. 9-11, Sep. 2000, pp. 1313-1320, XP004223349, ISSN: 0966-9795.

International Search Report, PCT International Patent Application No. PCT/DE2004/001683.

Written Opinion of the International Searching Authority, PCT International Patent Application No. PCT/DE2004/001683.

* cited by examiner

*Primary Examiner*—Ninh H Nguyen
(74) *Attorney, Agent, or Firm*—Kenyon & Kenyon LLP

(57) ABSTRACT

A run-in coating is for gas turbines. The run-in coating is used for sealing a radial gap between a housing of the gas turbine and rotating rotor blades of same, the run-in coating being applied onto the housing. The run-in coating is made of an intermetallic titanium-aluminum material.

16 Claims, 1 Drawing Sheet

RUN-IN COATING FOR GAS TURBINES AND METHOD FOR PRODUCING SAME

FIELD OF THE INVENTION

The present invention relates to a run-in coating for gas turbines and to a method for producing a run-in coating.

BACKGROUND INFORMATION

Gas turbines, such as, for example, aircraft engines, include, as a rule, a plurality of rotating rotor blades as well as a plurality of stationary stator blades, the rotor blades rotating together with a rotor, and the rotor blades as well as the stator blades being enclosed by a stationary housing of the gas turbine. It may be provided to optimize all components and subsystems when it comes to improving the performance of an aircraft engine. Among those are also the so-called sealing systems in aircraft engines. In aircraft engines, a particular problem is keeping a minimum gap between the rotating rotor blades and the stationary housing of a high pressure compressor. The highest absolute temperatures and temperature gradients occur in high pressure compressors, and this makes maintaining the gap of the rotating rotor blades from the stationary housing of the compressor more difficult. Among other things, this is also because in the case of compressor rotor blades shrouds, as are used in turbines, are omitted.

As was mentioned before, rotor blades in a compressor have no shrouds available to them. Therefore, ends, or rather tips of the rotating rotor blades are exposed to a direct frictional contact with the housing in the case of so-called brushing against the stationary housing. Such a brushing of the tips of the rotor blades against the housing is brought about by the setting of a minimum radial gap by manufacturing tolerances. Since, on account of the frictional contact of the tips of the rotating rotor blades to the housing, material is eroded, it is possible for an undesired gap enlargement to set in over the entire circumference of housing and rotor. In order to avoid this, the ends or tips of the rotating rotor blades may be fortified with a hard coating or with abrasive particles.

Another possibility of avoiding the wear at the tips of the rotating rotor blades and of assuring an optimized sealing between the ends or tips of the rotating rotor blades and the stationary housing, is to coat the housing with a so-called run-in coating. In material removal on a run-in coating, the radial gap is not enlarged over the entire circumference, but only in the shape of a sickle, as a rule. This avoids a drop in performance of the engine. Certain housings having a run-in coating are conventional.

SUMMARY

Example embodiments of the present invention may provide a new type of run-in coating for gas turbines.

The run-in coating according to example embodiments of the present invention for gas turbines may be used for sealing a radial gap between a stationary housing of the gas turbine and rotating rotor blades of the same. The run-in coating is applied onto the housing. The run-in coating may be produced from an intermetallic titanium-aluminum material.

The run-in coating made of the titanium-aluminum material may have a stepped or graded material composition and/or porosity. The run-in coating may be arranged to be less porous, at an inner region arranged directly adjacent to the housing and at an outer region arranged directly adjacent to the rotor blades, than between these two regions. Therefore, the run-in coating may be arranged to be denser and harder at the inner region arranged directly adjacent to the housing, and at the outer region arranged directly adjacent to the rotor blades. The inner region arranged directly adjacent to the housing may be used, in this context, to promote adhesion. The outer region arranged directly adjacent to the rotor blades is used to make available erosion protection.

Exemplary embodiments of the present invention are explained in more detail below with reference to the appended FIGURE.

DETAILED DESCRIPTION

Figure 1:
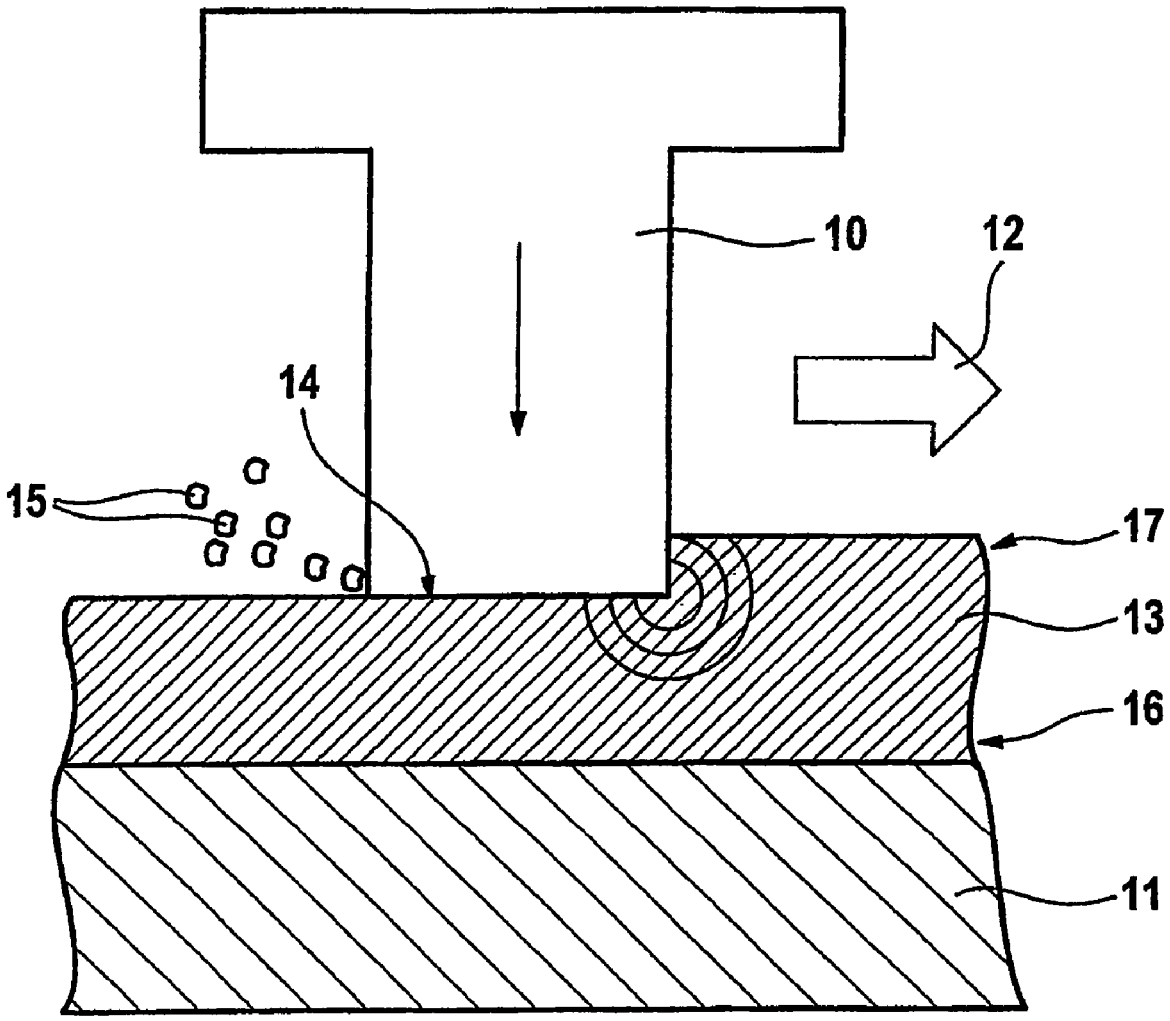
FIG. 1 is a schematic view of a rotor blade of a gas turbine together with a housing of the gas turbine and having a run-in coating arranged on the housing.

In a greatly schematic manner, FIG. 1 illustrates a rotating rotor blade 10 of a gas turbine, which rotates with respect to a stationary housing 11 in the direction of arrow 12. A run-in coating is arranged on housing 11. Run-in coating 13 is used to seal a radial gap between a tip or an end 14 of rotating rotor blade 10 and stationary housing 11. The demands made on such a run-in coating are very complex. Thus, for instance, the run-in coating may have to have optimized abrasive characteristics, that is, good chip formation and removability of the abraded material may need to be ensured. Furthermore, there may need to be not be any material transfer to rotating rotor blade 10. Run-in coating 13 may also need to have low frictional resistance. Moreover, run-in coating 13 may need to not ignite when rotating rotor blade 10 brushes against it. Additional demands made on run-in coating 13 may include erosion resistance, temperature stability, resistance to heat change, corrosion resistance with respect to lubricants and sea water, for example. FIG. 1 makes clear that, conditioned by centrifugal forces occurring during the operation of the gas turbine and the heating of the gas turbine, ends 14 of rotor blades 10 come into contact with run-in coating 13, and thus abraded material 15 is set free. This pulverized abraded material 15 may need to not cause any damage on rotating rotor blades 10.

Housing 11, illustrated schematically in FIG. 1, may be the housing of a high pressure compressor, for example. Such housings of high pressure compressors are increasingly made up of intermetallic materials of the type TiAl or $Ti_3Al$, etc. Such intermetallic titanium-aluminum materials have a low density and are superior to the usual titanium alloys, with respect to their temperature stability.

Example embodiments of the present invention include application of a run-in coating 13, also made of an intermetallic titanium-aluminum material, onto a housing 11 that is made of an intermetallic titanium-aluminum material. Such a run-in coating, made of an intermetallic titanium-aluminum material, may also be applied to a housing that is made of a usual titanium alloy.

Run-in coating 13 made of the intermetallic titanium-aluminum material may have a stepped material composition and/or porosity, that is, one which changes in a stepwise manner, or it may have a graded material composition and/or porosity, that is, one which changes in an almost stepless manner. The properties of run-in coating 13 may be adapted to the specific demands made on it by the selective setting of the material composition and/or the porosity.

Run-in coating 13 may have a low porosity in an inner region 16 that is directly adjacent to housing 11, and also in an outer region 17 that is directly adjacent to rotor blades 10.

Between this inner region 16 and this outer region 17, on the other hand, the porosity of the run-in coating may be increased. Inner region 16 of run-in coating 13, which is directly adjacent to housing 11, is used to promote adhesion between run-in coating 13 and housing 11. Outer region 17 of run-in coating 13, which is directly adjacent to rotor blades 10, forms an erosion protection. However, depending on the demands made on run-in coating 13, this erosion protection may also be omitted.

The ratio of titanium to aluminum within run-in coating 13, that is made of the intermetallic titanium-aluminum material, may be approximately constant. This means that, for example, exclusively the porosity of run-in coating 13 is made in stepped or graded fashion for influencing the hardness and rigidity.

It is also possible, however, that the ratio of titanium to aluminum within run-in coating 13 might be made in stepped or graded fashion. For example, more titanium may be included in the inner region 16 in run-in coating 13 that is directly adjacent to housing 11 than in outer region 17 of run-in coating 13. This means that in outer region 17 of run-in coating 13 more aluminum is included than in inner region 16 of same, which borders on housing 11.

The use of a run-in coating made of an intermetallic titanium-aluminum material on a housing which is also made of an intermetallic titanium-aluminum material, or of a titanium alloy, may provide that the fastening of the run-in coating to the housing takes place via chemical bonding, and thereby the fastening may be more secure and durable than is the case with conventional run-in coatings. Furthermore, between a run-in coating and a housing that have the same basic composition, no high temperature diffusion between the housing and the run-in coating may take place. Moreover, there may be no thermal expansion problems, since the housing and the run-in coating may uniformly expand or contract in response to temperature increase or temperature decrease. It is because of this that a uniform maintaining of the gap and a higher service life of the run-in coating may be achieved. A run-in coating hereof may also have a high resistance to oxidation, as well as a high stability to temperature change. The blade tips of the rotating rotor blades may be submitted to only a minimal blade tip abrasion.

A run-in coating 13 may be produced such that run-in coating 13 is made available in the form of a slip material, and is applied to housing 11 with the aid of slip technology. Such a slip material based on an intermetallic titanium-aluminum material may be applied onto housing 11 by brushing, dipping or spraying, etc. This may take place in several steps or rather layers, so that a multi-layer run-in coating 13 develops.

In order to set the desired porosity in the respective layers, additive substances are intercalated in the slip material. After the application of the slip material, hardening or baking of the slip material takes place onto housing 11. During baking, the additives added to the slip material evaporate, and because of this the pores inside run-in coating 13 remain behind. On account of the number and type of the added additive substances, one may set the number and the size of the pores.

Alternatively, run-in coating 13 may also be produced by applying it with the aid of a directed vapor jet. Such a directed vapor jet may be generated with the aid of a PVD method (physical vapor deposition) or a CVD method (chemical vapor deposition). Shortly before the impinging of the directed vapor jet that is based on an intermetallic titanium-aluminum material, at least one additive is fed in or incorporated into the vapor jet, these additives being vaporized again during the subsequent baking, and in the process leaving behind pores within the layer or each layer of run-in coating 13.

In the case of the additives for setting the porosity, so-called microballs, that is, tiny filled or hollow plastic beads, polystyrene beads or other materials may be involved which vaporize during the baking of the intermetallic titanium-aluminum material.

The run-in coating may be produced especially favorably both with the aid of slip technique and PVD or CVD technique.

What is claimed is:

1. A run-in coating for a gas turbine, comprising:

an intermetallic titanium-aluminum material adapted to be applied to a housing of the gas turbine and adapted to seal a radial gap between the housing of the gas turbine and rotatable rotor blades of the gas turbine;

wherein the run-in coating is less porous at a region facing the housing than at a region facing the rotor blades.

2. The run-in coating according to claim 1, wherein the run-in coating includes at least one of (a) a stepped and (b) a graded at least one of (a) a composition and (b) a porosity.

3. The run-in coating according to claim 1, wherein a ratio of titanium to aluminum in the run-in coating is approximately constant, exclusively a porosity adapted to set at least one of (a) a density, (b) a hardness and (c) a density of the run-in coating one of (a) stepped and (b) graded.

4. The run-in coating according to claim 1, wherein the housing is formed of an intermetallic titanium-aluminum material.

5. The run-in coating according to claim 4, wherein the run-in coating is directly applied onto the housing.

6. A run-in coating for a gas turbine, comprising:

an intermetallic titanium-aluminum material adapted to be applied to a housing of the gas turbine and adapted to seal a radial gap between the housing of the gas turbine and rotatable rotor blades of the gas turbine;

wherein the run-in coating is less porous at an inner region arranged directly adjacent to the housing and at an outer region arranged directly adjacent to the rotor blades than between the inner region and the outer region.

7. A run-in coating for a gas turbine, comprising:

an intermetallic titanium-aluminum material adapted to be applied to a housing of the gas turbine and adapted to seal a radial gap between the housing of the gas turbine and rotatable rotor blades of the gas turbine;

wherein a ratio of titanium to aluminum in the run-in coating is one of (a) stepped and (b) graded, the run-in coating including more aluminum at a region facing the rotor blades than at a region facing the housing.

8. A gas turbine, comprising:

a housing;

rotatable rotor blades; and a run-in coating including an intermetallic titanium-aluminum material applied to the housing and adapted to seal a radial gap between the housing and the rotor blades;

wherein the run-in coating is less porous at a region facing the housing than at a region facing the rotor blades.

9. A method for producing a run-in coating for a gas turbine, comprising:

applying the run-in coating onto a housing of the gas turbine to seal a radial gap between the housing and rotatable rotor blades of the gas turbine, the run-in coating including an intermetallic titanium-aluminum material;

wherein the run-in coating is applied in the applying step to be less porous at a region facing the housing than at a region facing the rotor blades.

10. The method according to claim 9, wherein the run-in coating is applied in the applying step to have one of (a) a stepped and (b) a graded at least one of (a) a material composition and (b) a porosity.

11. The method according to claim 9, wherein the housing is formed of an intermetallic titanium-aluminum material.

12. A method for producing a run-in coating for a gas turbine, comprising:

applying the run-in coating onto a housing of the gas turbine to seal a radial gap between the housing and rotatable rotor blades of the gas turbine, the run-in coating including an intermetallic titanium-aluminum material;

wherein the applying step includes applying at least one layer of a titanium-aluminum slip material onto the housing and subsequently hardening the titanium-aluminum slip material by baking.

13. The method according to claim 12, wherein additives are intercalated into each layer of the titanium-aluminum slip materials, the additives evaporated during baking and leaving behind pores within each layer of the run-in coating.

14. The method according to claim 12, wherein each layer of the titanium-aluminum slip material is applied in the applying step by at least one of (a) brushing, (b) dipping and (c) spraying.

15. A method for producing a run-in coating for a gas turbine, comprising:

applying the run-in coating onto a housing of the gas turbine to seal a radial gap between the housing and rotatable rotor blades of the gas turbine, the run-in coating including an intermetallic titanium-aluminum material;

wherein the applying step includes applying at least one titanium-aluminum layer onto the housing by at least one of (a) a directed vapor jet and (b) a PVD jet and subsequently hardening each layer by baking.

16. The method according to claim 15, wherein the applying step includes feeding additives into the jet shortly before impinging of the jet, the additives evaporated during baking and leaving behind pores in each layer of the run-in coating.

* * * * *